US005318006A

United States Patent [19]

Walen et al.

[11] Patent Number: 5,318,006

[45] Date of Patent: Jun. 7, 1994

[54] CUTTING INSERT UTILIZING SUPERABRASIVE COMPACTS

[75] Inventors: Robert C. Walen, Powell; Luther L. White, Dublin, both of Ohio

[73] Assignee: General Electric Company, Worthington, Ohio

[21] Appl. No.: 35,552

[22] Filed: Mar. 23, 1993

Related U.S. Application Data

[63] Continuation of Ser. No. 888,245, May 22, 1992, abandoned, which is a continuation of Ser. No. 557,906, Jul. 25, 1990, abandoned.

[51] Int. Cl.[5] ..... B28D 5/04

[52] U.S. Cl. ..... 125/36; 125/22

[58] Field of Search ..... 125/36, 21, 22, 23.01, 125/23.02; 51/149, 156, 206 R, 206 P, 211 R; 407/77, 102, 113

[56] References Cited

U.S. PATENT DOCUMENTS

| | | | |
|---|---|---|---|
| 3,886,926 | 6/1975 | Hall | 125/21 |
| 4,743,144 | 5/1988 | Shikata | 407/113 |
| 4,797,138 | 1/1989 | Komandon | 51/204 |
| 4,978,254 | 12/1990 | Langlois et al. | 57/206 P |

*Primary Examiner*—M. Rachuba

[57] ABSTRACT

Disclosed is a cutting insert, particularly an indexable cutting insert for mining applications. The illustrated embodiment is an indexable cutting insert for chain saws used in the quarrying of natural stone. The cutting insert has a support member and at least one cutting member attached to the support member, the cutting member having at least one cutting surface and comprising a selfbonded kalacrystaline superabrasive material being formed such that the cutting member has a width substantially less than its depth and attached to the support member such that the width is the cutting surface.

18 Claims, 1 Drawing Sheet

CUTTING INSERT UTILIZING SUPERABRASIVE COMPACTS

This is a continuation of U.S. patent application Ser. No. 07/888,245 filed on May 22, 1992, now abandoned, which is a continuation of U.S. patent application Ser. No. 07/557,906 filed on Jul. 28, 1990 also abandoned.

BACKGROUND OF THE INVENTION

1. Field

The invention relates to cutting inserts used in cutting operations, particularly indexable cutting inserts for mining applications. The illustrated embodiment of the invention is an indexable cutting insert for chain saws used in the quarrying of natural stone.

2. State of the Art

Tools used in natural stone quarries for the cutting of stone have generally been known for many years. Traditionally, stone has been cut by large channel machines and wire saws in commercial stone quarry operations. Approximately two decades ago, large carriage mounted chain saws which ride on tracks were introduced into stone quarries. The basic component of the stone quarry chain saw are a power unit, such as an electric, gas or hydraulic motor, which rotates a hardened steel chain around an arm. The hardened steel chain has cutter links interposed along its length which house cutting inserts.

Typically, the cutting insert is brazed to a holder which is attached to the cutter link. When the cutting insert becomes dull, broken or fractured, the cutting insert can be debrazed from the holder and replaced by brazing a new cutting insert to the holder, or the cutter link is removable from the chain saw chain so that the cutter link and attached holder and cutting insert can be replaced, or, if the wearing or damage is extensive, the entire chain saw chain can be replaced. The cutting inserts are usually grouped in sets along the chain, each set comprising a multiplicity of cutting inserts having an increasing kerf width.

These prior art chain saw cutting insert arrangements are relatively expensive to maintain and operate. When the cutting inserts need replacement, it necessitates the shutting down of the chain saw and quarrying operation for an extended period of time to replace the cutting inserts by the above stated methods. Also required for maintenance is an extensive inventory of cutting inserts of varying kerf width so that the appropriate cutting insert which has become dull, broken or fractured can be replaced. To minimize down time, inventories of entire chain saw chains are often maintained so that an entire chain can be replaced.

It is well known in the prior art to use carbide or tungsten carbide cutting inserts. However, carbide or tungsten carbide cutting inserts have been primarily useful in quarrying limestone, marble, slate and travertine, and have been found unsuitable for abrasive stone such as sandstone and some highly abrasive limestone. The highly abrasive materials cause excessive wearing of the carbide or tungsten carbide cutting insert, thereby resulting in short tool life and excessive down time in the quarrying operation for cutting insert replacement.

In recent years new materials have been developed which replace the carbide or tungsten carbide or at least the cutting surface of mining and drilling tools. Through the use of high pressure, high temperature technology, superabrasive materials such as polycrystaline diamond compacts, commonly known as "PDC," and polycrystaline cubic boron nitride compacts, known and sold by General Electric Company under the trademark "BZN® Compacts," have been produced for use as the cutting surfaces in drilling and mining tools. PDC materials which are useful for these purposes are disclosed in U.S. Pat. No. 32,380 which teaches a PDC material which is sold by General Electric Company under the trademark STRATAPAX®, U.S. Pat. No. 4,224,380 which teaches a thermally stable PDC, and U.S. Pat. No. 4,738,689 which teaches a coated thermally stable PDC, the latter materials being sold by General Electric Company under the trademark GEOSET®. BZN® Compacts are disclosed in U.S. Pat. Nos. 3,767,371 and 3,743,489. The foregoing General Electric Company patents are assigned to the same assignee as the present invention, and are incorporated herein by this reference.

In the prior art the superabrasive material is typically formed in a thin section having a narrow dimension and a broad dimension. The cutting surface is usually the surface along the broad dimension. The superabrasive material is typically bonded to a metallic substrate, with the metallic substrate oriented to support the cutting surface and minimize stress on the metallic substrate-superabrasive material joint.

In prior art chain saw cutting inserts, the superabrasive material is usually backed by and bonded to a metallic substrate which is manufactured of a harder material than the hardened steel of the cutter links. If the superabrasive material is bonded to the metallic substrate in the manufacturing process, the metallic substrate is then brazed to a carrier which is secured to the cutter link. Alternatively, the superabrasive material may be brazed to a carrier which is secured to the cutter link. The metallic substrate or the carrier is typically oriented to provide mechanical support for the superabrasive material to reduce fracturing thereof and to reduce stress on the superabrasive material-metallic substrate bond or superabrasive material-carrier braze joint. Metallic substrate materials which have been used in the past are carbide or a hard cemented metal such as cemented carbide. The prior art superabrasive material cutting inserts are also typically arranged in sets of increasing kerf widths. This also requires an inventory of superabrasive material cutter inserts of various widths to maintain the chain saw.

Square PDC blanks have been used as cutting inserts for chain saws in the prior art. Each of the corners of the PDC blank is a cutting surface. The PDC blank is brazed to a holder which is attached to the cutter link of the chain saw chain. After one corner of the PDC blank becomes worn, the PDC blank is debrazed from the holder, rotated ninety degrees and rebrazed to the holder. This operation is repeated until all four corners of one side of the PDC blank have been used as cutting surfaces. The PDC blank is then rotated one hundred eighty degrees to the opposite side and this process repeated. In this process, the PDC blank is repeatedly subjected to elevated temperatures and potential thermal damage. Since only the corners of the PDC blank are used as cutting surfaces, the remaining portions of the PDC blank is waste material.

SUMMARY OF THE INVENTION

Objectives

It is an objective of the invention to provide a cutting insert which utilizes a superabrasive material for the cutting surface and which is uniform in size. Further objectives of the invention are to provide a cutting insert which has an increased tool life and is less expensive to manufacture over prior art cutting inserts which utilize superabrasive materials through a decrease in the cost of tool fabrication through utilizing less superabrasive material and lower fabrication costs. Further objectives of the invention are to provide a cutting insert having multiple cutting surfaces which may be quickly indexed to a new cutting surface with minimal down time of the cutting operations and without multiple brazing to minimize elevated temperatures and potential thermal damage to the superabrasive material. Final objectives of the invention are to provide a cutting insert which utilizes a relatively thin section of superabrasive material oriented such that a small surface area of the superabrasive material is the cutting surface, which cuts through a slicing action, and which has the larger surface area of the superabrasive material bonded or brazed to a metallic substrate to minimize stress on the superabrasive material-substrate joint and optimize retention of the superabrasive material to the metallic substrate.

Features

In the accomplishment of the foregoing objectives, the invention is a cutting insert having a support member made of a metallic substrate which is bonded to a cutting member made of a superabrasive material, wherein the cutting member is shaped in a thin section and oriented such that at least one surface of the thin dimension of the cutting member is the cutting surface and the cutting action is that of slicing. It is also preferable that the thin section of cutting member be set into a pre-cut slot in the support member. Preferably the cutting insert has a multiplicity of cutting surfaces and a means for allowing consecutive indexing of each of the cutting surfaces into the cutting position as a cutting surface becomes dull, fractured or broken. In the illustrated embodiment, the cutting insert has eight cutting surfaces which are indexed into the cutting position through the loosening of a mounting bolt, rotating of the cutting insert to the new cutting surface and retighting of the mounting bolt.

Preferably the support member is either carbide or a cemented hard metal such as cemented carbide. The superabrasive material is preferably either a PDC of polycrystalline diamond, thermally stable polycrystaline diamond or coated thermally stable polycrystaline diamond, which are manufactured by General Electric Company and sold under the trademarks STRATAPAX® and GEOSET®; or a BZN® Compact. The PDC or BZN® Compact is preferably bonded to the support member by brazing, and it is also preferable to create a strong bond between the PDC or BZN® Compact and support member through the use of a high temperature brazing alloy. The use of a high temperature brazing alloy can be accomplished if the PDC which is utilized is the coated thermally stable PDC material as taught in recently issued U.S. Pat. No. 4,738,689. Alternatively, the use of a high temperature brazing alloy can be accomplished through the brazing techniques and materials taught in General Electric Company's U.S. Pat. Nos. 4,850,523, issued Jul. 25, 1989, and U.S. Pat. No. 4,899,922, issued Feb. 13, 1990. The foregoing General Electric Company patents are assigned to the same assignee as the present invention, and are incorporated herein by this reference.

THE DRAWING

DETAILED DESCRIPTION OF THE ILLUSTRATED EMBODIMENT

Figure 1:
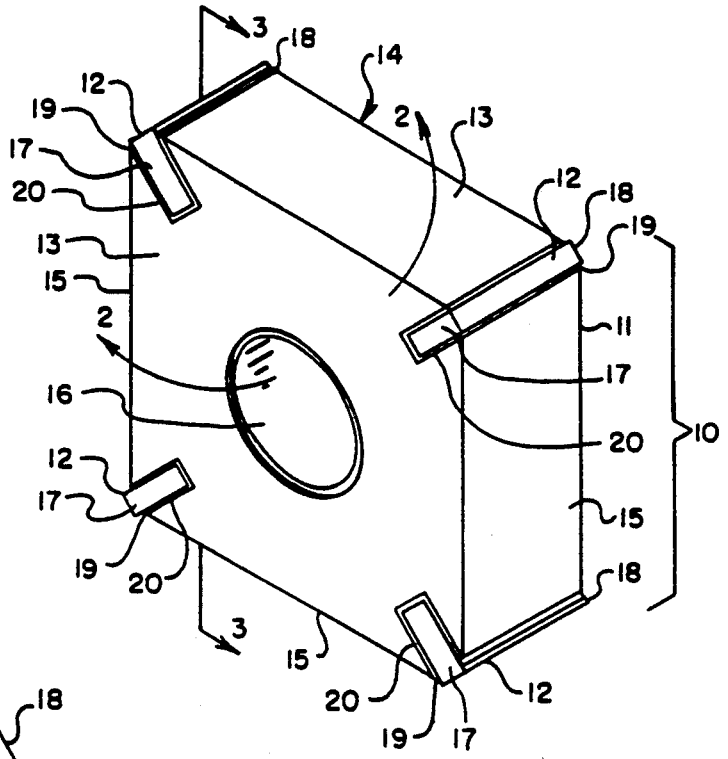
FIG. 1 is a perspective sideview of the cutting insert.
Figure 2:
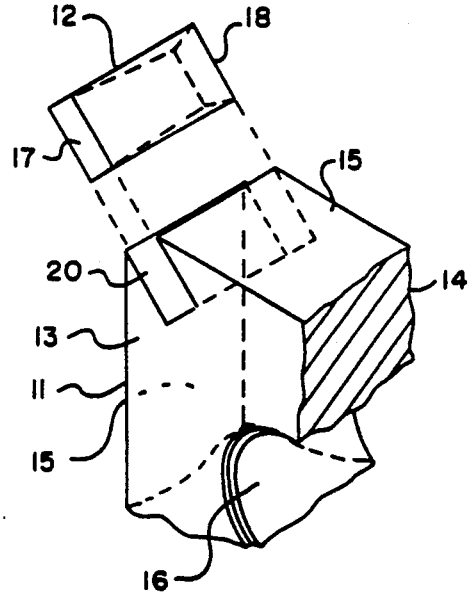
FIG. 2 is an exploded sectional view taken on line 2—2 of FIG. 1.
Figure 3:
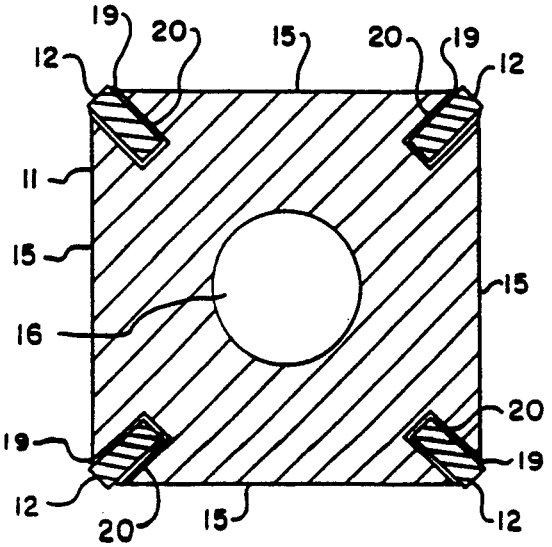
FIG. 3 is a vertical section taken on line 3—3 of FIG. 1.

Referring to FIG. 1, FIG. 2 and FIG. 3, cutting insert 10 has a support member 11 and at least one cutting member 12 attached to the support member 11. Preferably, there are more than one cutting member 12 attached to the support member 11 and each cutting member 12 has more than one cutting surface. The support member 11 is the portion of the insert 10 which allows for indexing and removable attachment of the insert 10 onto a cutting tool, such as a mining or drilling machine or a chain saw used in a stone quarry. Depending upon the type of cutting tool, the support member 11 may be of a variety of shapes to accommodate the attaching mechanism of the particular cutting tool. For a chain saw used in quarrying stone, a preferred shape of the support member 11 is a box having a first square surface 13, a second square surface 14 opposite the first square surface 13, and four rectangular sides 15.

Associated with the support member 11 is an attachment means for indexing and removably attaching the insert 10 to the cutting tool. A preferable attachment means is an attachment hole 16 extending through the support member 11 between the first square surface 13 and the second square surface 14 and which is positioned in the center of the square surfaces 13 and 14. Typically a bolt (not illustrated) extending through the attachment hole 16 is used to attach the support member 11 to the cutting tool such that the planes in which the first square surface 13 and second square surface 14 lie are substantially perpendicular to the direction of the cut being made by the cutting tool.

The cutting member 12 has at least one cutting surface. The plane in which the cutting surface lies is substantially perpendicular to the direction of the cut being made by the cutting tool. Preferably, the cutting member 12 has a first cutting surface 17, which lies substantially parallel to the first square surface 13, and a second cutting surface 18, which lies substantially parallel to the second square surface 14. The cutting member 12 is attached to the support member 11 such that the first cutting surface 17 is the leading portion of the insert 10 which comes into initial contact with material being cut when the first square surface 13 is the leading surface of the insert 10, and the second cutting surface 18 is the leading portion of the insert 10 which comes into initial contact with material being cut when the second square surface is the leading surface of the insert 10.

The cutting member 12 is shaped in the form of a thin section having a width which is substantially less than its depth. The edge of the thin section form the cutting surfaces, preferably with the longitudinal axis of the cutting member 12 oriented between the first cutting surface 17 and the second cutting surface 18. The cutting member 12 is of sufficient length such that the first cutting surface 17 is substantially in the plane in which the first square surface 13 lies and the second cutting surface 18 is substantially in the plane in which the second square surface 14 lies. Preferably, the longitudinal axis of cutting member 12 is substantially parallel to the direction of the cut being made by the cutting tool. For a chain saw insert it is preferred that the cutting member 12 be a thin rectangular box.

It is preferred that the cutting member 12 be mated to a pre-cut slot 20 in the support member 11. For a chain saw insert, the pre-cut slot 20 is located diagonally on one of the corners of support member 11. The setting of the cutting member 12 into the pre-cut slot 20 in the support member 11 allows for strong bonding between the support member 11 and cutting member 12 because of the increased surface area between the cutting member 12 and the support member 11, and for additional mechanical support which is provided by the partial encasement of the cutting member 12 in the support member 11.

If the shape of the insert 10 is a box, it is preferable to have four cutting members 12 mated into four pre-cut slots 20 located diagonally on each of the four corners of support member 11. This configuration results in four first cutting surfaces 17 and four second cutting surfaces 18 on insert 10. Assuming that the first square surface 13 is the leading surface of the insert 10, when one of the first cutting surfaces 17 becomes dull, the bolt (not illustrated) extending through attachment hole 16 is loosened and the insert 10 rotated 90° to a new first cutting surface 17 which is adjacent to the dull first cutting surface 17. After the four first cutting surfaces 17 have been used, the bolt extending through attachment hole 16 can be removed, the insert 10 rotated 180° and the bolt replaced so that the second square surface 14 is now the leading surface of the insert 10, thereby allowing for the utilization of the four second cutting surfaces 18 by the same 90° rotation process described above.

The support member 11 is made of a metallic substrate and the cutting member 12 is made of a superabrasive compact. The metallic substrate used in the support member 11 is preferably carbide or a cemented hard metal, such as cemented carbide. If the metallic substrate is cemented carbide, it is preferably selected from the group consisting of cemented tungsten carbide, cemented titanium carbide, cemented tungsten-molybdenum carbide, and cemented tantalum carbide.

The superabrasive compact used in the cutting member 12 is preferably a PDC or a BZN ® Compact. If the superabrasive compact is a PDC, it is preferably selected from the group consisting of polycrystaline diamond, thermally stable polycrystaline diamond, and coated thermally stable polycrystaline diamond.

Preferably, the cutting member 12 is bonded to the support member 11 by brazing using a brazing alloy 19. One such method of brazing is disclosed in General Electric Company's U.S. Pat. No. 4,850,523, issued Jul. 25, 1989, which has been incorporated herein by reference. That patent teaches a method for bonding a thermally stable PDC or a BZN ® Compact to a carbide substrate wherein the carbide substrate is placed in thermal contact with a heat sink and the thermally stable PDC is placed in thermal contact with a heat source during the brazing operation. Such fabrication technique avoids the residual stresses which otherwise would result by virtue of the differential of the coefficients of thermal expansion between the carbide substrate and the thermally stable PDC. This brazing technique also takes advantage of the high thermal conductivity of the thermally stable PDC.

Another useful brazing technique is disclosed in General Electric Company's U.S. patent application Ser. No. 4,899,922, issued Feb. 13, 1990, which has been incorporated herein by reference That patent teaches the brazing of a thermally stable PDC to a carbide substrate using a brazing alloy having a liquidus above about 700° C. and containing an effective amount of chromium, with the proportion of chromium ranging between 1% to 20% and advantageously being between 5% and 20% by weight of the braze alloy composition. In this brazing technique, a thermally stable PDC can be bonded to a carbide substrate by disposing the chromium-containing braze alloy between the thermally stable PDC and carbide substrate and furnace brazing the composite. In this technique, the chromium braze alloy may be placed between the thermally stable PDC and carbide substrate through the use of a disk, wire, or foil; or, in the alternative, either the surface of the thermally stable PDC which is to be mated with the carbide substrate or the entire thermally stable PDC can be coated with the chromium braze alloy through the use of known deposition technology.

Kerf width can be obtained using the insert 10 by utilizing a group of the inserts 10 aligned on the longitudinal axis of the cut such that the cutting members 12 of each successively aligned insert 10 are slightly offset from one another. By arranging the inserts 10 in this manner, a uniform size of insert 10 can be utilized to obtain varying kerf widths. This reduces the amount of parts inventory required to maintain the cutting tool, thereby reducing the cost of the cutting operation. Also, forming the cutting member 12 in a thin section reduces the cost of manufacture by using less material than in prior art superabrasive material inserts. The use of the removable attachment means for attaching the insert 10 onto the cutting tool, such as the described bolt hole, provides for ease in indexing cutting surfaces or changing inserts with relatively low down time of the cutting tool and cutting operation, and without repeatedly exposing the insert to elevated temperatures and potential thermal damage.

Whereas this invention is here illustrated and described with specific reference to an embodiment thereof presently contemplated as the best mode in carrying out such invention, it is to be understood that various changes may be made in adapting the invention to different embodiments without departing from the broad inventive of concepts disclosed herein and comprehended by the claims that follow.

We claim:

1. A cutting insert comprising:

(a) a support member; and (b) at least one cutting member brazed to the support member, the cutting member having at least one cutting surface and comprising a selfbonded polycrystalline superabrasive material being formed such that the cutting member has a width substantially less than its depth ad attached to the support member such that the width is the cutting surface, such that the brazing conditions minimize thermal damage to the support member ad superabrasive materials.

2. A cutting insert as recited in claim 1 wherein the insert has a means for indexing the insert to different cutting surfaces.

3. A cutting insert as recited in claims 1 or 2 wherein the selfbonded polycrystaline superabrasive material is selected from the group consisting of cubic boron nitride, polycrystaline diamond, thermally stable polycrystaline diamond and coated thermally stable polycrystaline diamond.

4. A cutting insert as recited in claim 1 or 2 wherein the support member is a cemented metal carbide.

5. A cutting insert as recited in claim 4 wherein the cemented metal carbide is selected from the group consisting of cemented tungsten carbide, cemented titanium carbide, cemented tungsten carbide and cemented tantalum carbide.

6. A cutting insert comprising:

(a) a support member having at least one pre-cut slot therein; and (b) at least one cutting member brazed to the support member, the cutting member having at least one cutting surface and being formed as to mate to the pre-cut slot and comprising a selfbonded polycrystaline superabrasive material being formed such that the cutting member has a width substantially less than its depth and attached to the support member such that the width is the cutting surface, such that the brazing conditions minimize thermal damage to the support member and superabrasive material.

7. A cutting insert as recited in claim 6 wherein the insert has a means for indexing the insert to different cutting surfaces.

8. A cutting insert as recited in claims 6 or 7 wherein the selfbonded polycrystaline superabrasive material is selected from the group consisting of cubic boron nitride, polycrystaline diamond, thermally stable polycrystaline diamond and coated thermally stable polycrystaline diamond.

9. A cutting insert as recited in claims 6 or 7 wherein the support member is a cemented metal carbide.

10. A cutting insert as recited in claim 9 wherein the cemented metal carbide is selected from the group consisting of cemented tungsten carbide, cemented titanium carbide, cemented tungsten-molybdenum carbide and cemented tantalum carbide.

11. A cutting insert as recited in claims 6 or 7 wherein the support member and the cutting member are attached to each other by brazing.

12. A method for making a cutting insert, which comprising brazing a support member to at least one cutting member, the cutting member having at least one cutting surface and comprising a selfbonded polycrystalline superabrasive material being formed having a width substantially less than its depth and attached to the support member such that the width is the cutting surface, such that the brazing conditions minimize thermal damage to the support member and superabrasive material.

13. A method for making a cutting insert as recited in claim 12 wherein the insert has a means for indexing the insert to different cutting surfaces.

14. A method for making a cutting insert as recited in claims 12 or 13 wherein the selfbonded polycrystaline superabrasive material is selected from the group consisting of cubic boron nitride, polycrystaline diamond, thermally stable polycrystaline diamond and coated thermally stable polycrystaline diamond.

15. A method for making a cutting insert as recited in claims 12 or 13 wherein the support member is a cemented metal.

16. A method for making a cutting insert as recited in claim 15 wherein the cemented metal is selected from the group consisting of cemented tungsten carbide, cemented titanium carbide, cemented tungsten-molybdenum carbide and cemented tantalum carbide.

17. A method for making a cutting insert as recited in claims 12 or 13 wherein the support member and cutting member are attached by brazing.

18. A cutting insert consisting essentially of:

(a) a support member; and (b) at least one cutting member brazed to the support member, the cutting member having at least one cutting surface and comprising a selfbonded polycrystalline superabrasive material being formed such that the cutting member has a width substantially less than its depth and attached to the support member such that the width is the cutting surface, such that the brazing conditions minimize thermal damage to the support member and superabrasive material.

* * * * *